US008629831B2

(12) United States Patent
Park et al.

(10) Patent No.: US 8,629,831 B2
(45) Date of Patent: Jan. 14, 2014

(54) LOCAL-DIMMING METHOD, LIGHT SOURCE APPARATUS PERFORMING THE LOCAL-DIMMING METHOD AND DISPLAY APPARATUS HAVING THE LIGHT SOURCE APPARATUS

(75) Inventors: Sang-Il Park, Seoul (KR); Yong-Hoon Kwon, Chungcheongnam-do (KR); Se-Ki Park, Gyeonggi-do (KR); Gi-Cherl Kim, Gyeonggi-do (KR); Si-Joon Song, Gyeonggi-do (KR)

(73) Assignee: Samsung Display Co., Ltd. (KR)

( * ) Notice: Subject to any disclaimer, the term of this patent is extended or adjusted under 35 U.S.C. 154(b) by 845 days.

(21) Appl. No.: 12/415,359

(22) Filed: Mar. 31, 2009

(65) Prior Publication Data

US 2010/0060671 A1 Mar. 11, 2010

(30) Foreign Application Priority Data

Sep. 5, 2008 (KR) ..... 2008-87849

(51) Int. Cl.
*G09G 3/36* (2006.01)

(52) U.S. Cl.
USPC ..... 345/102; 345/690

(58) Field of Classification Search
USPC ..... 345/102
See application file for complete search history.

(56) References Cited

U.S. PATENT DOCUMENTS

| | | | | |
|---|---|---|---|---|
| 6,888,529 | B2 | 5/2005 | Bruning | |
| 2002/0075253 | A1* | 6/2002 | Park et al. | 345/211 |
| 2005/0007332 | A1* | 1/2005 | Eiden et al. | 345/102 |
| 2005/0110720 | A1* | 5/2005 | Akimoto et al. | 345/76 |
| 2005/0110740 | A1* | 5/2005 | Linzmeier et al. | 345/102 |
| 2005/0231457 | A1* | 10/2005 | Yamamoto et al. | 345/102 |
| 2006/0262078 | A1* | 11/2006 | Inuzuka et al. | 345/102 |
| 2007/0032260 | A1* | 2/2007 | Kim | 455/550.1 |
| 2007/0139449 | A1 | 6/2007 | Bergquist et al. | 345/691 |

FOREIGN PATENT DOCUMENTS

| | | |
|---|---|---|
| JP | 2007-52105 | 3/2007 |
| KR | 2003-0087870 | 11/2003 |
| KR | 10-2007-0100040 | 10/2007 |
| KR | 10-2008-0052105 | 11/2008 |

OTHER PUBLICATIONS

English Abstract for KR Pat. Pub. No. 1020030089870, 1 page.
English Abstract for KR Pat. Pub. No. 1020070100040, 1 page.
English Abstract for JP Pat. Pub. No. 2007-052105, 1 page.
English Abstract for KR Pat. Pub. No. 1020080052105, 1 page.
English Abstract for KR Pat. Pub. No. 1020020084125, 1 page.

* cited by examiner

*Primary Examiner* — Sumati Lefkowitz
*Assistant Examiner* — Jose Soto Lopez
(74) *Attorney, Agent, or Firm* — Innovation Counsel LLP

(57) ABSTRACT

A light source module of a display device comprises light-emitting blocks each of which comprises multiple sets of light sources, with different sets emitting different colors (e.g. red, green and blue). Each set is independently controllable according to one or more driving parameters. A local-dimming method comprises: (a) in each color-dimming period, driving each light-emitting block by the first color-dimming process; (b) in each compensating period, driving each light-emitting block by a full-color process which is independent of the image; (c) in each compensating period, sensing emitted light and determining the one or more driving parameters' reference driving values operable to generate a reference color; (d) in at least one of the color-dimming and compensating periods, driving each light-emitting block using the one or more driving parameters' values which depend on the reference driving values; and (e) between a color-dimming period and an adjacent compensating period, gradually switching the light-source module between the first color-dimming process and the full-color process.

22 Claims, 8 Drawing Sheets

LOCAL-DIMMING METHOD, LIGHT SOURCE APPARATUS PERFORMING THE LOCAL-DIMMING METHOD AND DISPLAY APPARATUS HAVING THE LIGHT SOURCE APPARATUS

PRIORITY STATEMENT

This application claims priority under 35 U.S.C. §119 to Korean Patent Application No. 2008-87849, filed on Sep. 5, 2008 in the Korean Intellectual Property Office (KIPO), the contents of which are herein incorporated by reference in their entirety.

BACKGROUND OF THE INVENTION

1. Field of the Invention

The present invention relates to a local-dimming method, a light source apparatus performing the local-dimming method and a display apparatus having the light source apparatus. More particularly, the present invention relates to a local-dimming method of driving light-emitting blocks which incorporates color dimming, a light source apparatus performing the local-dimming method and a display apparatus having the light source apparatus.

2. Description of the Related Art

Liquid crystal display (LCDs) devices are used in a wide range of portable and stationary applications including laptop computers, small-size and large-size television sets, and other applications, because the LCDs have low power consumption and are thin and light-weight. An LCD device includes an LCD panel displaying an image by controlling light transmissivity of liquid crystal and also includes a backlight assembly disposed behind the LCD panel and providing light to the LCD panel.

The LCD panel includes an array substrate having a plurality of thin-film transistors (TFTs) arranged in a matrix. Another substrate (e.g. a color filter substrate in a color LCD) faces the array substrate. A liquid crystal layer is disposed between the array substrate and the color filter substrate. The backlight assembly includes a light source such as a cold cathode fluorescent lamp (CCFL). Recently light-emitting diodes (LED) having been used as light sources due to their low power consumption and high color reproducibility.

In order to reduce power consumption and increase the contrast ratio, modern LCD devices use local dimming technology which controls the light energy emitted by the backlight assembly based on the image being displayed. In dimming technology, if the image is dark, then the light source is dimmed but the liquid crystal is made more transmissive to compensate for the dimming and obtain the desired luminance. The dimming can be based on the highest brightness present in the image. In an LCD using the local dimming technology, the LCD panel is divided into blocks, and each block is dimmed separately based on the image portion corresponding to the block (e.g. based on the highest luminance of the block's image portion). Some such LCDs use one-dimensional dimming technology if the backlight assembly includes a linear-shaped light source such as a linear lamp, or use two-dimensional dimming technology if the backlight assembly has an array of point light sources such as LEDs.

Some LCD devices combine red, green and blue LEDs to generate white light for the LCD panel. In such devices, further reduction of the power consumption can be obtained using a three-dimensional dimming technology (referred to as "color-dimming") which provides separate luminance control over the LEDs of each color depending on the image being displayed. For example, the image may allow a block's red LEDs to be dimmed more than the green or blue LEDs, and correspondingly the liquid crystal is made more transmissive for the red LEDs than for the green or blue LEDs. Improved techniques for color dimming are desired.

SUMMARY

This section summarizes some features of the invention. Other features are described in subsequent sections. The invention is defined by the appended claims.

As LEDs age, their output power changes (decreases after a period of use). Further, the red, green and blue LEDs age at different rates, causing color shift and in particular white light imbalance. Variations in operating temperature can also cause change in the LED output power. The LEDs' input power should therefore be periodically adjusted to compensate for such changes. The adjustments have been performed by means of sensing the light energy generated by the LEDs, but the sensors' output is difficult to interpret if the LEDs' output changes with the image being displayed as in color-dimming.

This section summarizes some features of the invention. Other features are described in subsequent sections.

Some embodiments of the present invention provide a local-dimming method for driving a light source module in a display device, the light source module comprising a plurality of independently controllable light-emitting blocks, each of the light-emitting blocks comprising a plurality of sets of light sources, each set of light sources consisting of one or more light sources, different sets of light sources of each light-emitting block emitting different colors, different sets of light-sources being independently controllable according to one or more driving parameters to allow each light-emitting block to be driven by a first color-dimming process in which each light-emitting block's output chromaticity and luminance depend on an image displayed by the display device, the local-dimming method comprising: (a) in each of one or more color-dimming periods of time, driving each said light-emitting block by the first color-dimming process; (b) in each of one or more compensating periods of time, driving each said light-emitting block by a full-color process which is independent of the image; (c) in each of said one or more compensating periods of time, while driving each said light-emitting block by the full-color process, sensing light emitted by at least one of the light sources, and based on the sensing, determining the one or more driving parameters' reference driving values operable to generate a reference color by the light-emitting blocks; (d) in at least one of the color-dimming and compensating periods of time, driving each said light-emitting block using the one or more driving parameters' values which depend on the reference driving values; and (e) between at least one of the color-dimming periods and an adjacent one of the compensating periods, gradually switching the light-source module between a state in which the luminance of each said light-emitting block is determined by the first color-dimming process and a state in which the luminance of each said light-emitting block is determined by the full-color process.

Some embodiments provide a light source apparatus comprising: a light source module comprising a plurality of light-emitting blocks, each of the light-emitting blocks comprising a plurality of sets of light sources, each set of light sources consisting of one or more light sources, different sets of light sources of each light-emitting block emitting different colors, each set of light-source being associated with respective one or more driving parameters determining an input power provided to each light-source of the set to allow each light-emitting block to be driven by a first color-dimming process in which each light-emitting block's output chromaticity and luminance depend on an image displayed by the display device; and a local-dimming driving part providing the one or more driving parameters to the sets of the light-sources, the local-dimming part comprising a light sensing part sensing light emitted by the light source module and comprising circuitry for: (a) in each of one or more color-dimming periods of time, determining each said set's driving parameters using the image to perform the first color-dimming process on each said light-emitting block; (b) in each of one or more compensating periods of time, determining each said set's driving parameters independently of the image to drive each said light-emitting block by a full-color process; (c) in each of said one or more compensating periods of time, while driving each said light-emitting block by the full-color process, determining the one or more driving parameters' reference driving values based on the light sensing part's output, the one or more driving parameters' reference driving values generating a reference color by the light-emitting blocks; (d) in at least one of the color-dimming and compensating periods of time, driving each said light-emitting block using the one or more driving parameters' values which depend on the reference driving values; and (e) between at least one of the color-dimming periods and an adjacent one of the compensating periods, gradually switching the light-source module between a state in which the luminance of each said light-emitting block is determined by the first color-dimming process and a state in which the luminance of each said light-emitting block is determined by the full-color process.

Some embodiments provide a display apparatus comprising: a display panel displaying an image; a light source module including a plurality of light-emitting blocks, each of the light-emitting blocks including a plurality of color light sources; and a local-dimming driving part driving the light source module by a first color-dimming process using color-dimming levels determined based on an image portion corresponding to each of the light-emitting blocks, adjusting the light emitted by the color light sources in a full-color process during a compensating period, and driving the light-emitting blocks to have to gradually change the total luminance of the light-emitting blocks during transitions between a state in which all the light-emitting blocks are driven by the first color-dimming process and a state in which all the light-emitting blocks are driven by the full-color process.

According to some embodiments of the present invention, the light emitted by light sources of different colors is periodically adjusted to obtain a reference white light with a target luminance and target chromatic coordinates.

BRIEF DESCRIPTION OF THE DRAWINGS

The above and other features and advantages of the present invention will become more apparent by describing in detailed example embodiments thereof with reference to the accompanying drawings.

DETAILED DESCRIPTION OF SOME EMBODIMENTS

Figure 1:
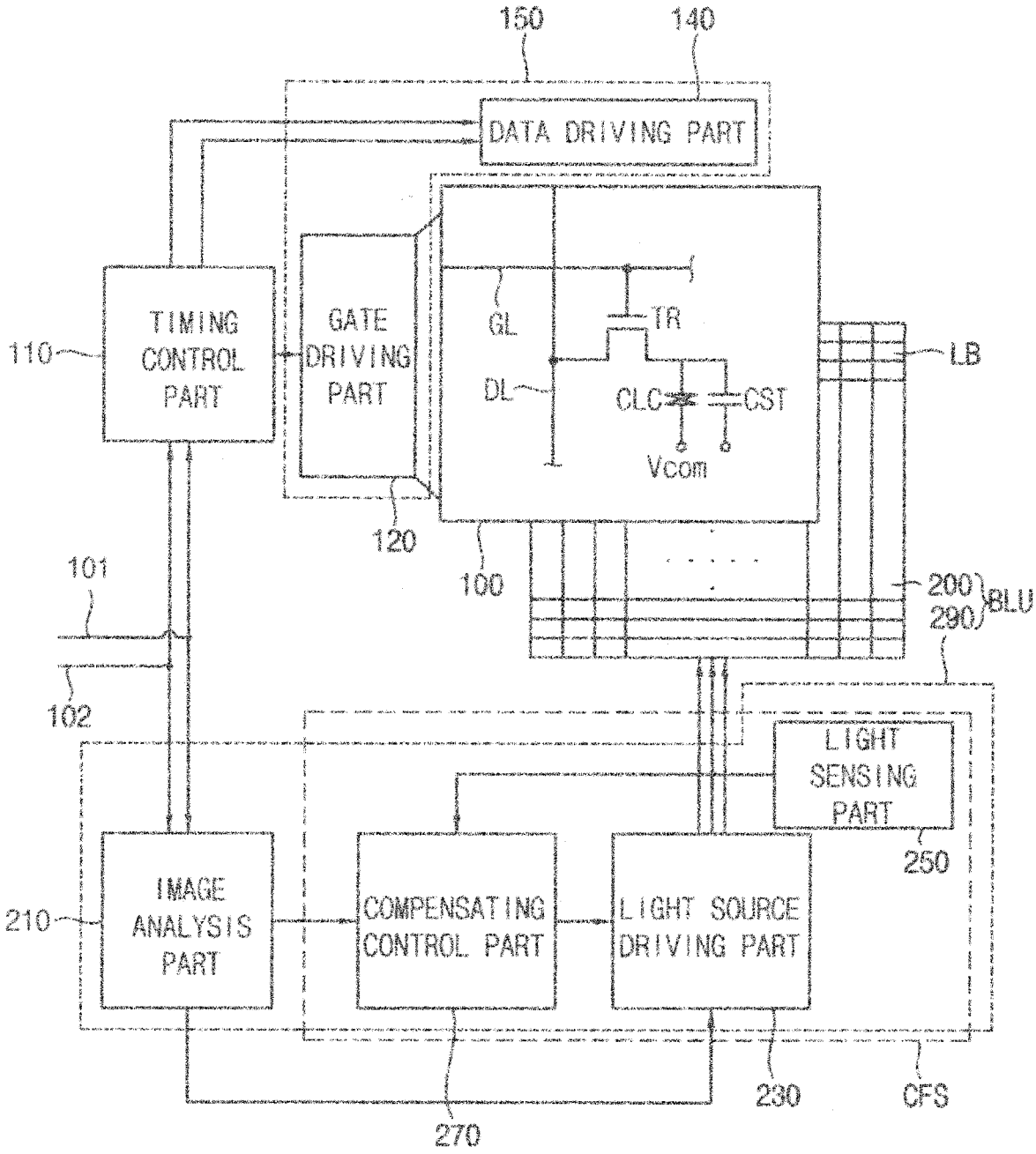
FIG. 1 is a block diagram illustrating a display device according to an example embodiment of the present invention.

Some embodiments of the present invention will now be described with reference to the accompanying drawings. However, the present invention is not limited to these embodiments.

In the drawings, the sizes and relative sizes may be exaggerated for clarity.

It will be understood that when an element is referred to as being "on," "connected to" or "coupled to" another element, then intervening elements may or may not be present. In contrast, when an element is referred to as being "directly on," "directly connected to" or "directly coupled to" another element, then no intervening elements are present. Like numerals refer to like elements throughout.

It will be understood that the terms "first", "second", "third" etc. may be used herein as reference labels to distinguish one element from another. These reference labels are interchangeable and not limiting.

Spatially relative terms such as "beneath," "below," "lower," "above," "upper" and the like, may be used herein to describe one element's relationship to another as illustrated in the figures. These terms do not limit possible spacial orientations of the elements in manufacturing, use or operation unless indicated to the contrary. For example, devices illustrated in the figures can be turned upside down and/or rotated at any angle as needed.

The figures can be schematic in nature and not intended to illustrate each detail. Actual devices may include variations due, for example, to manufacturing techniques and/or tolerances, and such variations are within the scope of the present disclosure of invention.

FIG. 1 is a block diagram illustrating a display apparatus according to an example embodiment of the present invention. The display apparatus includes a display panel 100, a timing control part 110, a panel driving part 150 and a light source apparatus BLU.

The display panel 100 includes a plurality of pixels ("device pixels"). Each device pixel includes a switching element TR electrically connected to respective gate and data lines GL and DL, and includes a liquid crystal capacitor CLC and a storage capacitor CST that are electrically connected to the switching element TR. The liquid crystal capacitor CLC controls the orientation of liquid crystal molecules based on a data voltage received on the data line DL. The orientation is controlled to display suitable luminance. The data voltage is delivered to the capacitor when the switching element TR is turned on. The storage capacitor CST is used to help maintain the data voltage steady when the switching element TR is off.

The timing control part 110 receives a synchronization signal 101 and an image signal 102 from outside. Based on the synchronization signal 101, the timing control part 110 generates timing signals which control the panel driving part 150 in driving the gate lines GL and data lines DL. The timing signals include a clock signal, a vertical start signal and a horizontal start signal.

The panel driving part 150 includes a gate driving part 120 and a data driving part 140. The gate driving part 120 outputs a gate signal to the gate lines GL. The data driving part 140 converts the image signal received from the timing control part 110 into an analog-type data signal, and outputs the analog-type data signal to the data lines DL.

The light source apparatus BLU includes a light source module 200 and a local-dimming driving part 290 which controls the color and luminance provided by each light-emitting block LB of the light source module 200. Each light emitting block LB corresponds to a block of pixels directly opposite to the light emitting block.

The light source module 200 includes light sources of different colors on a printed circuit board (PCB). The light sources include red, green, blue, and possibly white light sources (e.g. LEDs). In some embodiments, for example, the red LEDs emit red light in the wavelength range of about 580 nm to about 700 nm, the green LEDs emit green light in the wavelength range of about 460 nm to about 630 nm, and the blue LEDs emit blue light in the wavelength range of about 400 nm to about 500 nm.

The local-dimming driving part 290 includes an image analysis part 210, a light source driving part 230, a light sensing part 250 and a compensating control part 270.

Figure 3:
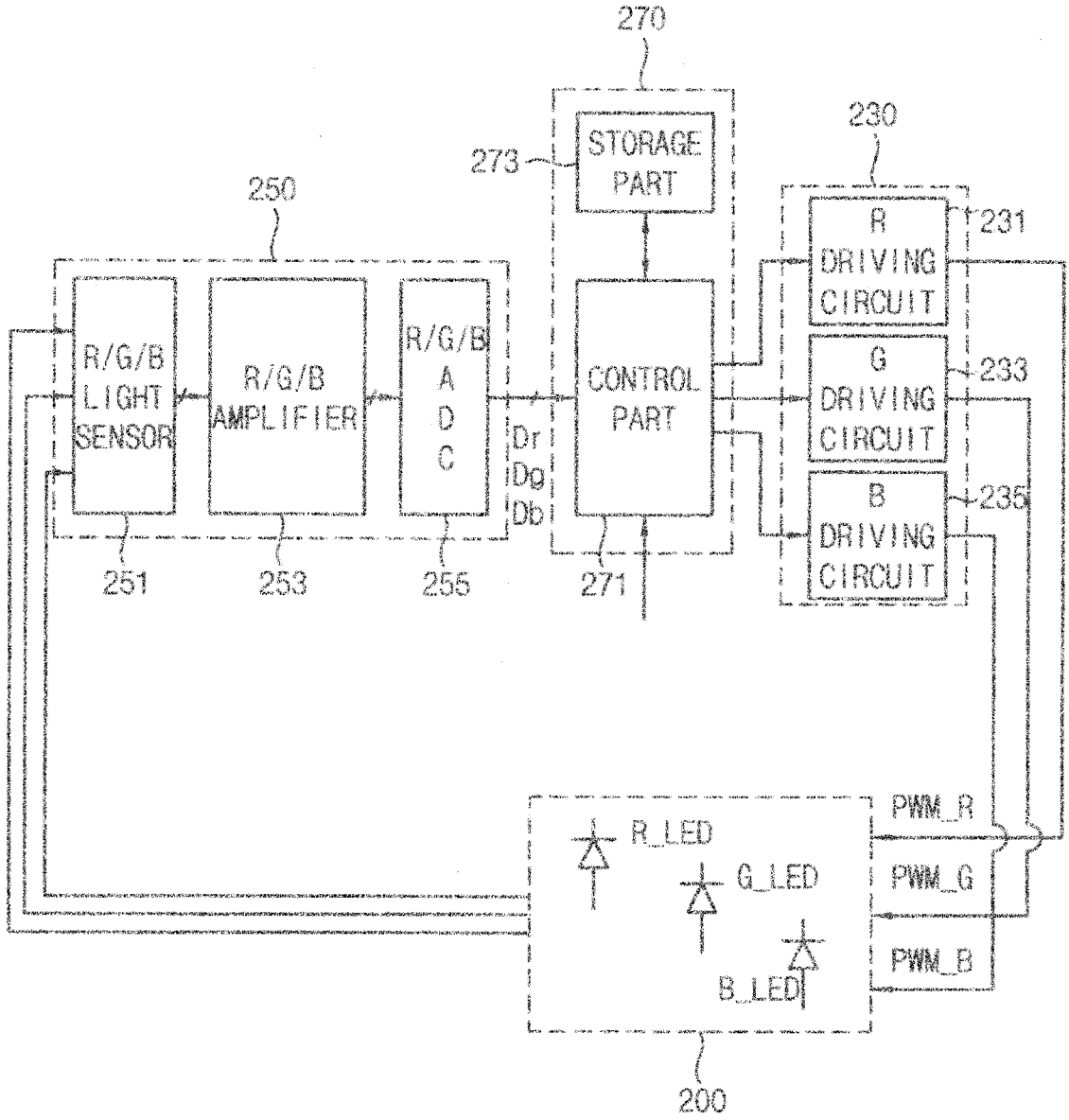
FIG. 3 is a block diagram illustrating a color feedback apparatus of the display device of FIG. 1.

The light source driving part 230 provides a color driving signal to the light-emitting blocks LB. In the example of FIG. 3, for each light-emitting block LB, the color driving signal includes a red driving signal PWM_R, a green driving signal PWM_G, and a blue driving signal PWM_B. These three signals determine the duty ratios for the block's red LEDs, green LEDs, and blue LEDs respectively. For each light-emitting block LB, the color driving signal is generated based on one or more LED driving parameters obtained by the light source driving part 230 from the compensating control part 270, and more particularly from control part 271 described below. The LED driving parameters may be duty-ratio data specifying the red, green and blue duty ratios as described below.

In the color-dimming mode, the LED driving parameters are generated based on the image signal analyzed by the image analysis part 210. The image consists of a plurality of pixels ("image pixels") each of which must be displayed in one or more device pixels of the LCD. The image analysis part 210 analyzes the image signal for each frame or some other unit of display and determines the dimming level for each light-emitting block LB. For example, the image signal portion to be displayed in each display section (each block of device pixels) directly opposite to a light-emitting block LB can be recognized by the image analysis part 210 based on the synchronization signal. For each image pixel in that portion, the image analysis part 210 obtains grayscale data values (i.e. digital values corresponding to desired light intensities) for the red, green and blue primary colors. For each display section the red, green and blue grayscale data values for the display section's device pixels are used to obtain red, green and blue "representative" grayscale data values (e.g., the representative grayscale data value for each color can be the maximum value or the average value of the color's intensity in the display section). The red, green and blue representative values for each light emitting block LB are used by the image analysis part 210 to determine the color-dimming levels (defining the output power for the LEDs of each color) for the light-emitting block LB. Thus, the image analysis part 210 determines the color-dimming levels for each light-emitting block LB based on the chromatic and luminance information in the image signal.

The color-dimming levels are used to define the luminance of each of the red, green and blue LEDs of each light-emitting block LB. Typically, the luminance of each of the red, green and blue LEDs of each light-emitting block LB is defined as an increasing function of the corresponding red, green or blue representative values of the corresponding display section.

If any of the red, green and blue LEDs of a light-emitting block LB are dimmed (i.e. its luminance is smaller than some maximum luminance in the full-white mode), then the corresponding device pixels are made more transmissive if possible, i.e. the corresponding pixel data are increased if they are not at the maximum possible value.

In the color-dimming mode, the LED driving parameters generated by the compensating control part 270 depend on the color-dimming levels, and hence the light source driving part 230 generates the color driving signal based on the color-dimming levels for each light-emitting block LB. The data driving part 140 adjusts the data voltages to increase the liquid crystal transmissivity at the device pixels in accordance with the color-dimming levels.

The light sensing part 250 senses the light power emitted by the light source module 200 and outputs digital-type color sensing data. The color sensing data includes red, green and blue sensing data. For example, the light sensing part 250 may sense red, green and blue light generated by the red, green and blue LEDs. As described below, in some embodiments the sensing is disabled in the color-dimming mode, but is used in full-color (full-white) operation in the compensating mode described below (i.e. when the LEDs are driven to generate a reference white light independent of the image signal).

The light source apparatus BLU has at least two modes of operation as described below with reference to FIG. 4: color-dimming mode and compensating mode. As described above, in the color-dimming mode, the compensating control part 270 ignores the output of the light sensing part 250 and controls the light source driving part 230 responsively to the image signal analyzed by the image analysis part 210. The light sensing part 250 may be disabled at this time.

The compensating mode includes a compensating period and first and second transitional periods. During the compensating period, the light source apparatus BLU does not perform color-dimming but drives the light source module 200 with "full-white" color to generate the reference white light (i.e. the white light with target luminance and target chromatic coordinates) independently of the image signal. Since no dimming is performed, the data driving part 140 does not perform dimming-dependent adjustment of the liquid crystal transmissivity. In the compensating period, the light sensing part 250 is enabled, and the compensating part 270 uses the light sensing signals to adjust the LED driving parameters as needed to generate the reference white light. The LED driving parameters' values needed to generate the reference white light are called herein "LED driving parameters' reference values". If the LED driving parameters specify duty-ratios, then in the compensating mode the LED driving parameters should have reference duty-ratio values needed to generate the reference white light. The reference duty-ratio values may be called herein duty-ratio reference data or red, green, and blue duty-ratio reference data. These duty-ratio reference data are stored in the compensating part 270 and used in the subsequent color-dimming period or periods as described below. The compensating mode operation of the compensating control part 270 is initiated by the enable signal provided by the image analysis part 210.

More particularly, during the compensating period, the compensating control part 270 compares the red, green and blue digitized sensing data (Dr, Dg, Db in the example of FIG. 3) from the light sensing part 250 with pre-stored reference-intensity data defining the red, green and blue intensities of the reference white light. Based on this comparison, the compensating control part 270 adjusts the duty-ratio reference data (the reference values of the LED driving parameters) defining how the LEDs should be driven to generate the reference white light. The new duty-ratio reference data are saved in storage (storage part 273 in FIG. 3) in the compensating control part 270.

In the first and second transitional periods in the compensating mode, the compensating control part 270 controls the light source driving part 230 to cause a gradual transition of the total luminance emitted by the light source module 200 so that the user would not notice the transitions between the compensating mode and the color-dimming mode. Without the transitional periods, the transitions may be noticeable despite the liquid crystal transmissivity adjustments made by the data driving part 140 to compensate for color-dimming. The light sensing part 250 may be disabled in the first and second transitional periods.

Below, the light source driving part 230, the light sensing part 250 and the compensating control part 270 are referred to as a color feedback apparatus CFS.

Figure 2:
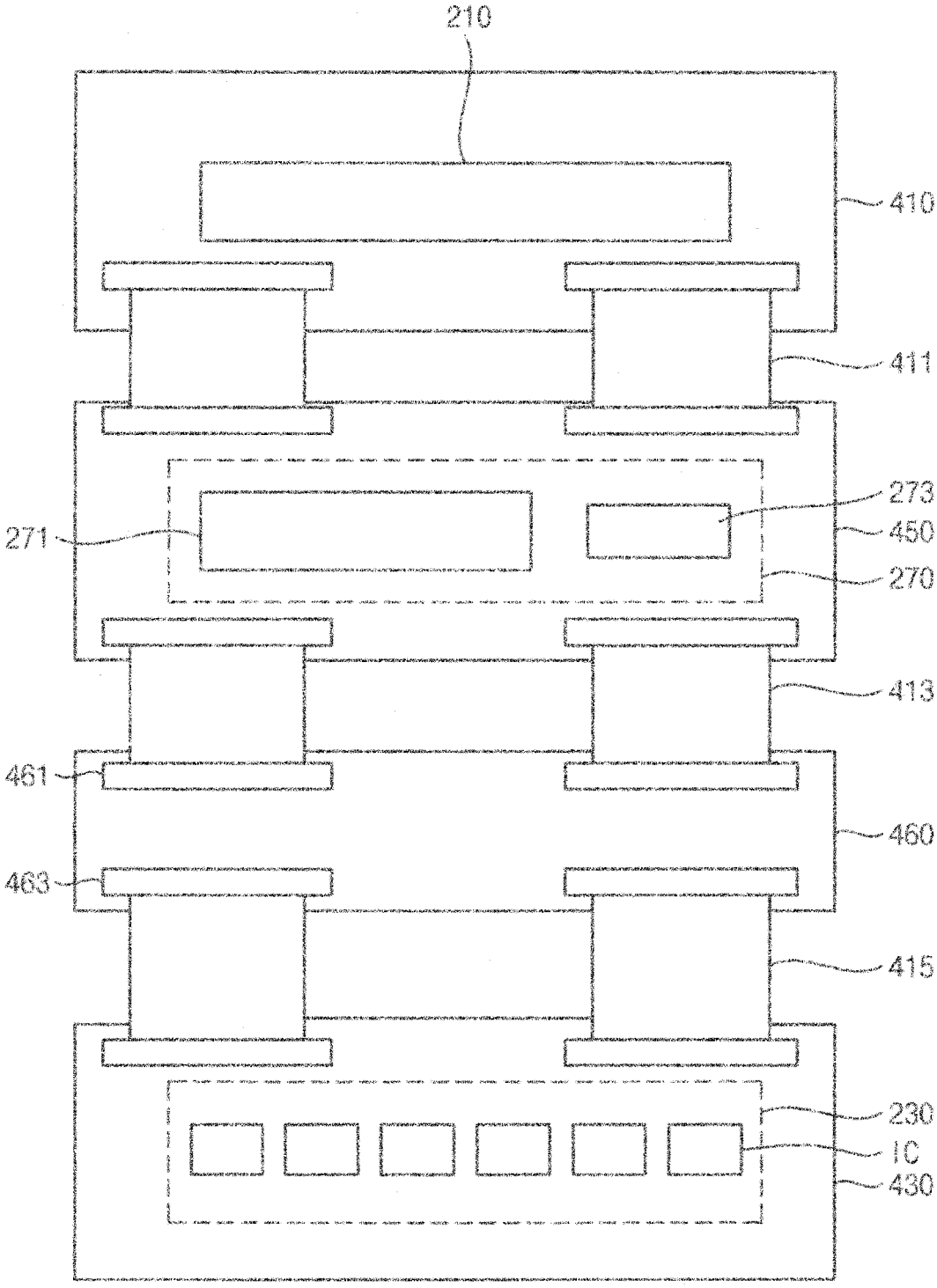
FIG. 2 is a block diagram illustrating a local-dimming driving part of the display device of FIG. 1.

FIG. 2 is a block diagram illustrating a local-dimming driving part of the device of FIG. 1. The local-dimming driving part includes a first PCB 410, a second PCB 430, a third PCB 450 and a sub-PCB 460. The image analysis part 210 is disposed on the first PCB 410. The light source driving part 230 is disposed on the second PCB 430. The light source driving part 230 includes a plurality of driving chips (integrated circuits, "ICs") driving the red, green and blue light sources.

The compensating control part 270 is disposed on the third PCB 450. The third PCB 450 is disposed between the first and second PCBs 410 and 420, to electrically connect the first PCB 410 to the second PCB 420.

For example, when the enable signal generated from the image analysis part 210 disposed on the first PCB 410 is received by the compensating control part 270 disposed on the third PCB 450, the compensating control part 270 generates a control signal to place the light source driving part 230 in the compensating mode and outputs the control signal to the second PCB 430.

The sub-PCB 460 is disposed between the second PCB 430 and the third PCB 450, to transfer an output signal from the third PCB 450 to an input for the second PCB 430. For that purpose, the third PCB 450 may include an output connector, and the second PCB 430 may include an input connector.

The first PCB 410 and the third PCB 450 are electrically connected to each other through a first connecting member 411. The third PCB 450 and the sub-PCB 460 are electrically connected to each other through a second connecting member 413. The sub-PCB 460 and the second PCB 430 are electrically connected to each other through a third connecting member 415. For example, the first to third connecting members 411, 413 and 415 may be connected to connectors disposed on the first to third PCBs 410, 430 and 450. Alternatively, the first to third PCBs 410, 430 and 450 may be interconnected through an anisotropic conductive film (ACF).

FIG. 3 is a block diagram illustrating the color feedback apparatus CFS of the device of FIG. 1. The color feedback apparatus CFS includes the light source driving part 230, the light sensing part 250 and the compensating part 270.

The light source driving part 230 includes a red ("R") driving circuit 231, a green ("G") driving circuit 233 and a blue ("B") driving circuit 235. The red driving circuit 231 outputs the red driving signals PWM_R to the red light sources R_LED (e.g. the red LEDs) of the light-emitting blocks LB. The green driving circuit 233 outputs the green driving signals PWM_G to green light sources (e.g. the green LEDs) G_LED. The blue driving circuit 235 outputs the blue driving signals PWM_B to blue light sources (e.g. the blue LEDs) B_LED. In some embodiments, one red driving signal PWM_B, one green driving signal PWM_G, and one blue driving signal PWM_B are generated for each light-emitting block LB.

The light sensing part 250 includes at least one R/G/B light sensor 251, at least one R/G/B amplifier 253 and at least one R/G/B analog-to-digital converter (ADC) 255. Each R/G/B light sensor 251 is disposed in an area of the light source module 200 to sense the red, green and blue light from the adjacent red, green and blue light sources R_LED, G_LED and B_LED of the light source module 200 and to output the red, green and blue sensing signals. The R/G/B amplifier 253 amplifies the red, green and blue sensing signals and outputs respective red, green and blue sensing amplified signals Vr, Vg and Vb. The R/G/B amplifier 253 may include an operational amplifier (OP-AMP) having a low pass filter (LPF). The R/G/B ADC 255 converts the red, green and blue sensing amplified signals Vr, Vg and Vb to respective digital-type red, green and blue sensing data Dr, Dg and Db.

The compensating control part 270 includes the control part 271 and the storage part 273. The control part 271 controls the red, green and blue driving circuits 231, 233, 235.

The storage part 273 stores the reference driving data defining the LED input power needed for the reference white light. The reference driving data include red, green and blue reference driving data corresponding to the target luminance and the target chromatic coordinates of the reference white light. The red, green and blue reference driving data include respectively red, green and blue duty-ratio reference data defining the duty-ratios of the red, green and blue driving signals needed to emit the reference white light.

The control part 271 compares the reference-intensity data stored by the storage part 273 to the digitized sensing data Dr, Dg, Db and adjusts the reference driving data through a compensating algorithm. The storage part 273 is provided with the reference-intensity data during manufacturing tests. The storage part 273 can also be provided with initial reference driving data during manufacturing or in a compensating period performed at the very start of the operation.

The color feedback apparatus CFS operates as follows. In the compensating period, full-white operation is performed. More particularly, the control part 271 provides the red, green and blue duty-ratio reference data stored in the storage part 273 to the respective red, green and blue driving circuits 231, 233 and 235 as the LED driving parameters. The red, green and blue driving circuits 231, 233 and 235 generate the red, green and blue driving signals PWM_R, PWM_G and PWM_B based on the red, green and blue duty-ratio reference data, and output the red, green and blue driving signals PWM_R, PWM_G and PWM_B to the light source module 200. Accordingly, the light source module 200 is driven by the full-white method.

The R/G/B light sensor 251 senses the power of the red, green and blue light emitted by the light source module 200 and outputs the red, green and blue sensing signals. The R/G/B amplifier 253 amplifies the red, green and blue sensing signals and outputs the red, green and blue sensing amplified signals Vr, Vg and Vb. The R/G/B ADC 255 converts the red, green and blue sensing amplified signals Vr, Vg and Vb into the digital-type red, green and blue sensing data Dr, Dg and Db.

The control part 271 compares the red, green and blue sensing data Dr, Dg and Db to the red, green and blue reference intensity data stored by the storage part 273. If the sensing data and the reference intensity data are different from each other, the control part 271 adjusts (compensates) the values of the red, green and blue duty-ratio reference data in the storage part 273 through the compensating algorithm. The control part 271 outputs these adjusted values to the red, green and blue driving circuits 231, 233 and 235 as the LED driving parameters. Consequently, the light source module 200 is driven in accordance with the compensated reference driving data.

Figure 4:
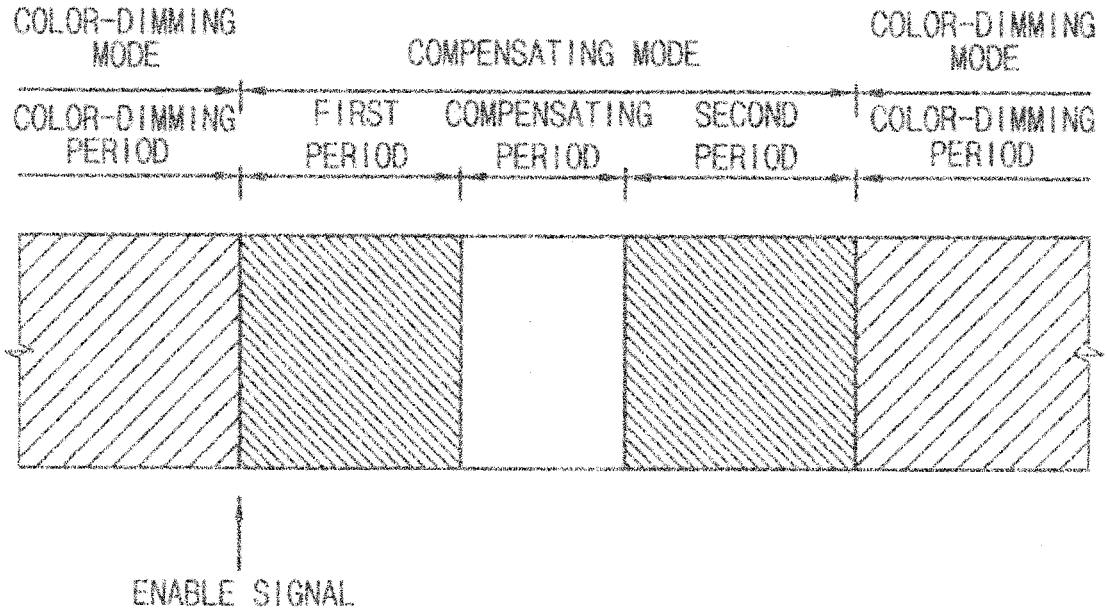
FIG. 4 is a timing diagram illustrating the operation of the light source apparatus of the display device of FIG. 1.
Figure 5:
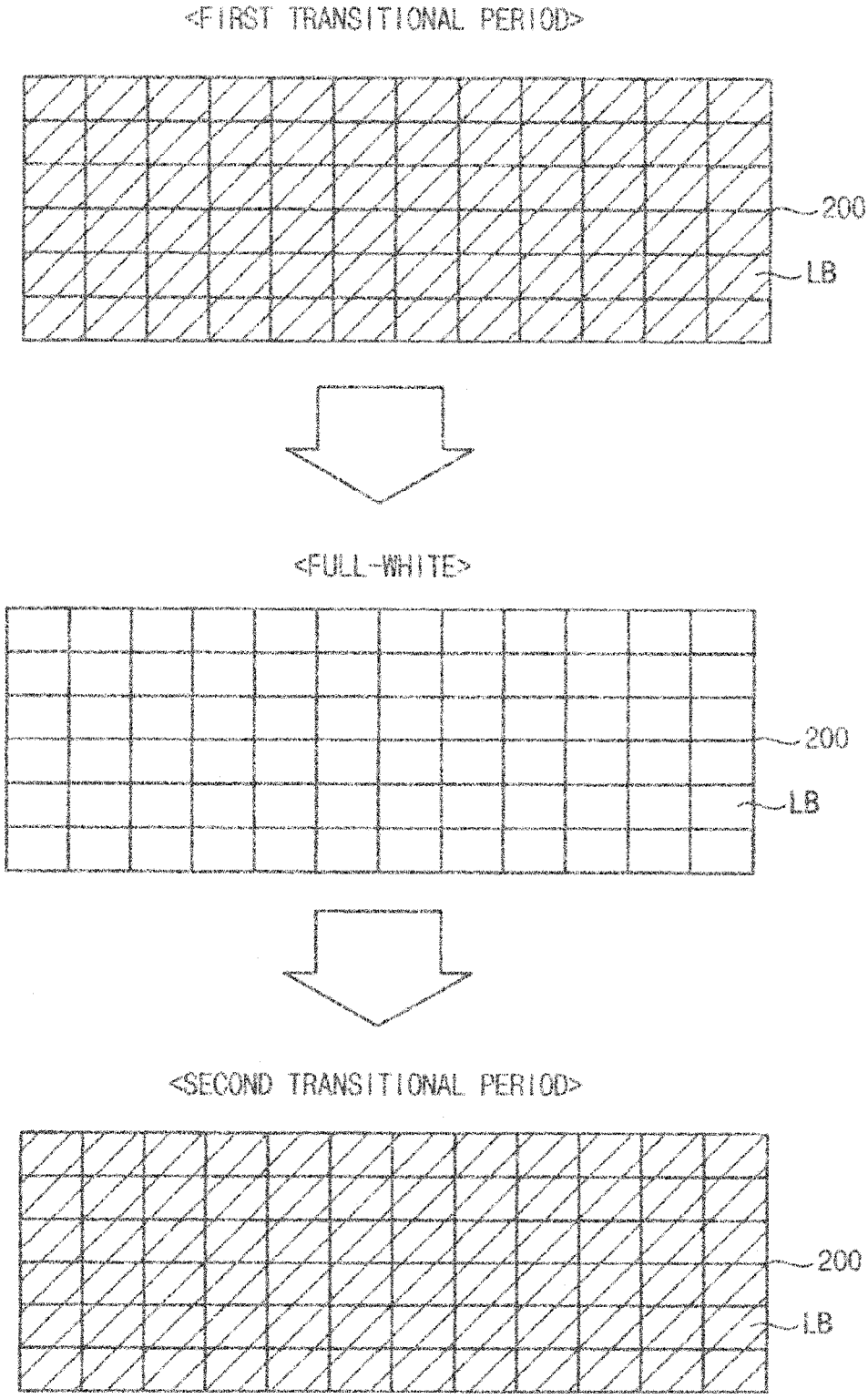
FIG. 5 is a plan view illustrating a light source module at different stages of operation conducted according to FIG. 4.

FIG. 4 is a timing diagram illustrating the operation of the light source apparatus of FIG. 1. FIG. 5 is a plan view illustrating the light source module at different stages of operation conducted according to FIG. 4.

Referring to FIGS. 3 to 5, most of the time the light source apparatus BLU operates in color-dimming mode. In this mode, the image analysis part 210 determines the color-dimming levels for each light-emitting block LB based on the image signal. The color-dimming levels include the red, green and blue dimming levels.

The control part 271 combines the red, green and blue dimming levels with the red, green and blue duty-ratio reference data stored in the storage part 273 to generate the LED driving parameters for the color-dimming operation. The light source driving part 230 generates the red, green and blue driving signals for each light-emitting block LB based on these LED driving parameters. Accordingly, the light-emitting blocks LB are driven with color-dimming.

Periodically, the light source apparatus BLU enters the compensating mode to update the red, green and blue duty-ratio reference data as described above. The compensating mode is entered when the image analysis part 210 outputs the enable signal to the compensating control part 270.

When the compensating mode is entered, the first transitional period begins. In this period, the LED driving parameters provided by the compensating control part 270 to the light source driving part 230 are transitional parameters that cause a gradual transition of each light-emitting block LB to the full-white operation. In some embodiments, the transition occurs over a number of frames. For each frame, the image analysis part 210 may operate as in the color-dimming mode, i.e. the image analysis part 210 determines the color-dimming levels for each light-emitting block LB based on the image signal and provides the color-dimming levels to the control part 271. The control part 271 combines the color-dimming levels with the red, green and blue duty-ratio reference data stored in the storage part 273 to generate the LED driving parameters for the first transitional period. The LED driving parameters are generated to be in the range between their value in the color-dimming mode and their value in the full-white (image-independent) mode. In some embodiments, for example, a linear interpolation is used. More particularly, for each primary color (red, green and blue), the LED luminance of each light emitting block LB for each frame f may be computed as:

$$L=L_{cd}*(1-f/F_1)+L_{fw}*f/F_1 \quad (1)$$

where:

$F_1$ is a number one greater than the total number of frames in the first transitional period, i.e. the first transitional period contains $(F_1-1)$ frames;

f is the current frame number counted from the start of the first transitional period, i.e. f varies from 1 to $F_1-1$ over the first transitional period; thus, f=0 is the last frame of the color-dimming period, and $f=F_1$ is the first frame of the compensating period;

$L_{cd}$ is the color-dimming luminance computed by the image analysis part 210 for the current frame f; the computation is performed as in the color-dimming mode;

$L_{fw}$ is the full-white luminance defined by the respective red, green or blue duty-ratio reference data.

Of note, the values L, $L_{cd}$, and $L_{fw}$ are each a triple of values for the red, green and blue colors.

The equation (1) defines the LED luminance L as a function of $L_{cd}$, $L_{fw}$, and f. For any fixed $L_{cd}$ and $L_{fw}$ such that $L_{cd}$ is less than $L_{fw}$, for each primary color, the LED luminance L is a gradually increasing function of the current frame number f.

Alternatively, in some embodiments in the first transitional period, the control part 271 operates as in the color-dimming mode, but the image analysis part 270 determines the color-dimming levels according to the right-hand side of the equation (1). The invention is not limited to any particular block that may perform the computation (1) or to any particular way to perform the computation.

Non-linear interpolations and other techniques can also be used for determining the LED luminance L.

Then the compensating period begins (see the middle drawing in FIG. 5). The compensating control part 270 drives the light source module 200 by the full-white method, and adjusts the red, green and blue duty-ratio reference data in the storage part 273 using the light sensing data as described above.

More particularly, the compensating control part 270 outputs the red, green and blue duty-ratio reference data stored in the storage part 273 to the light source driving part 230 as the LED driving parameters. The light source driving part 230 generates the red, green and blue driving signals based on the red, green and blue duty-ratio reference data. The light source module 200 is driven by the full-white method with the red, green and blue driving signals. The light sensing part 250 senses the power of the red, green and blue light generated by the light source module 200 and outputs the red, green and blue sensing data. The red, green and blue sensing data are used by the compensating control part 270 to adjust the red, green and blue duty-ratio reference data in the storage part 273 through the compensating algorithm if the red, green and blue digital sensing data Dr, Dg, Db are different from the red, green and blue reference intensity data stored in the storage part 273.

In the compensating period, the power of light emitted by the light source module 200 is repeatedly sensed and adjusted as described above. In some embodiments, the compensating period may include about 20 frames.

During the compensating period, the image analysis part 210 is disabled. It does not generate the red, green and blue dimming levels. The display panel 100 displays a real-time image.

After the compensating period, the second transitional period begins (see the bottom drawing in FIG. 5). In this period, the LED driving parameters provided by the compensating control part 270 to the light source driving part 230 are transitional parameters that cause gradual transition of each light-emitting block LB from the full-white driving back to color-dimming. In some embodiments, the transition occurs over a number of frames. For each frame, the image analysis part 210 may operate as in the color-dimming mode, i.e. the image analysis part 210 determines the color-dimming levels for each light-emitting block LB based on the image signal and provides the color-dimming levels to the control part 271. The control part 271 combines the color-dimming levels with the red, green and blue duty-ratio reference data stored in the storage part 273 to generate the LED driving parameters for the second transitional period. The LED driving parameters are generated to be in the range between their value in the color-dimming mode and their value in the full-white (image-independent) mode. In some embodiments, for example, a linear interpolation is used. More particularly, for each primary color (red, green and blue), the LED luminance of each light emitting block LB for each frame f may be computed as:

$$L=L_{cd}*f/F_2+L_{fw}*(1-f/F_2) \quad (2)$$

where:

$F_2$ is a number one greater than the total number of frames in the second transitional period, i.e. the second transitional period contains $(F_2-1)$ frames;

f is the current frame number counted from the start of the second transitional period, i.e. f varies from 1 to $F_2-1$ over the second transitional period; thus, f=0 is the last frame of the compensating period, and $f=F_2$ is the first frame of the color-dimming period;

$L_{cd}$ is the color-dimming luminance computed by the image analysis part 210 for the current frame f the computation is performed as in the color-dimming mode;

$L_{fw}$ is the full-white luminance defined by the respective red, green or blue duty-ratio reference data.

Of note, the values L, $L_{cd}$, and $L_{fw}$ are each a triple of values for the red, green and blue colors.

The equation (2) defines the LED luminance L as a function of $L_{cd}$, $L_{fw}$, and f For any fixed $L_{cd}$ and $L_{fw}$ such that $L_{cd}$ is less than $L_{fw}$, for each primary color, the LED luminance L is a gradually decreasing function of the current frame number f.

Alternatively, in some embodiments in the second transitional period, the control part 271 operates as in the color-dimming mode, but the image analysis part 270 determines the color-dimming levels according to the right-hand side of the equation (2). The invention is not limited to any particular block that may perform the computation (2) or to any particular way to perform the computation.

Non-linear interpolations and other techniques can also be used for determining the LED luminance L.

After the second transitional period, the light source module 200 is driven again in the color-dimming mode. The compensating mode can be entered at predetermined times, e.g. periodically at regular intervals of time.

Thus, the transitional periods are provided between the color-dimming mode periods and the compensating periods to provide gradual transitions between the color-dimming mode and he compensating period to make these transitions imperceptible to humans.

Figure 6:
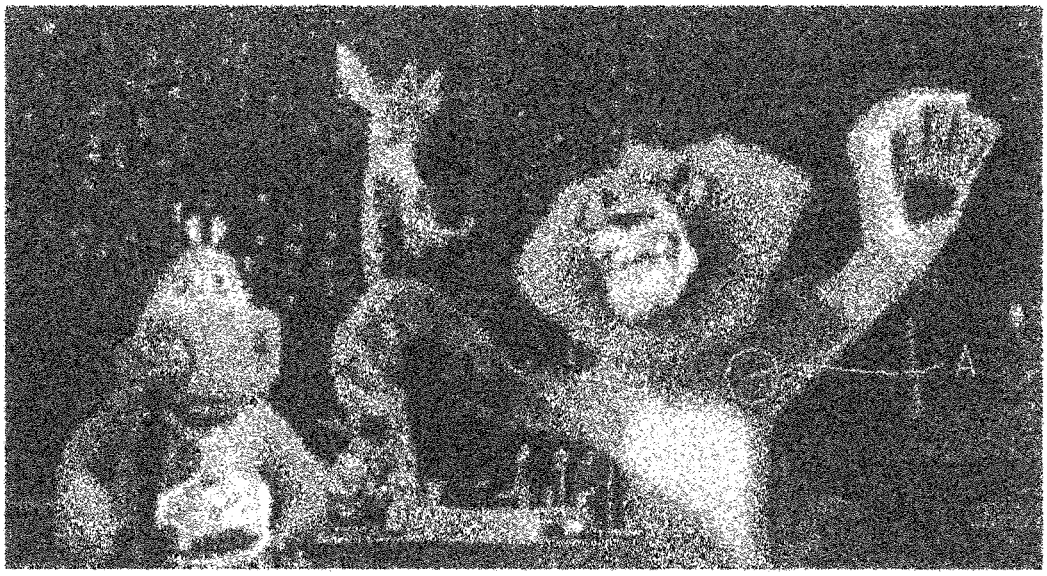
FIG. 6 is a plan view illustrating an image displayed by the display apparatus of FIG. 1.
Figure 7:
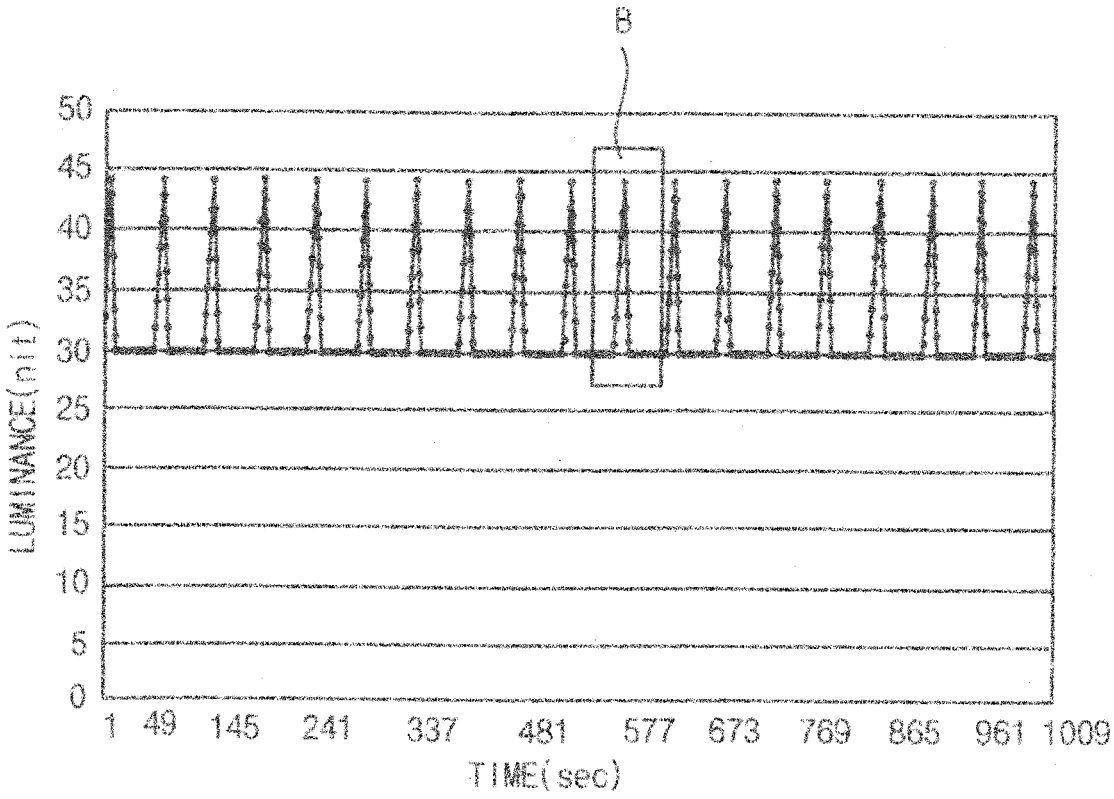
FIG. 7 is a graph showing the luminance of a light-emitting block or blocks at a portion 'A' of FIG. 6.
Figure 8:
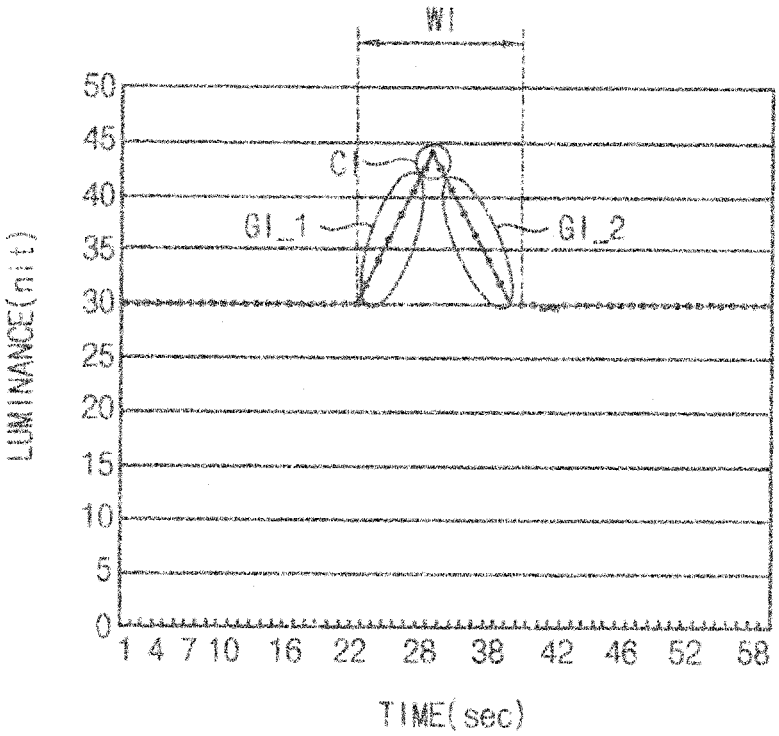
FIG. 8 is an enlarged graph of a portion 'B' of FIG. 7.
Figure 9:
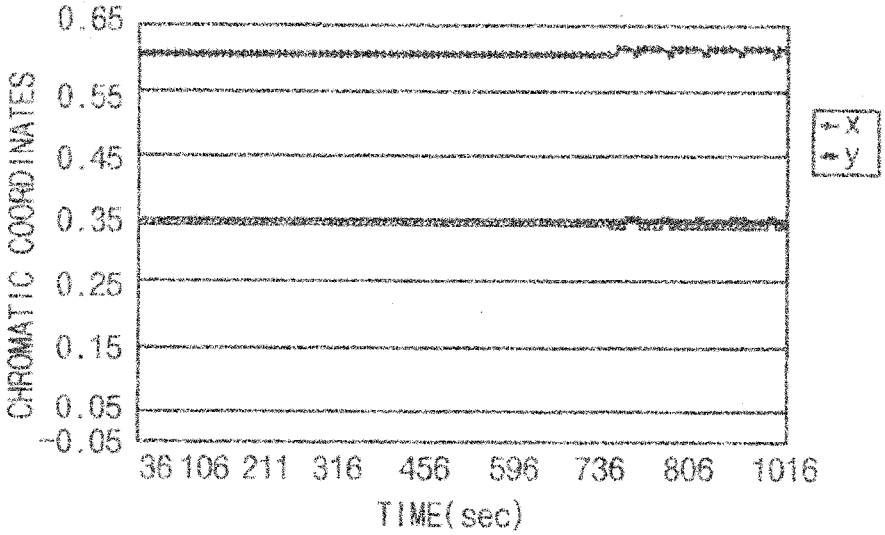
FIG. 9 is a graph showing chromatic coordinates at the portion 'A' of FIG. 6.

FIG. 6 illustrates an image displayed by the display apparatus of FIG. 1. FIG. 7 is a graph showing the total luminance emitted by a number of the light-emitting blocks LB located at a portion 'A' of FIG. 6. The luminance is shown as a function of time. FIG. 8 is an enlarged graph of a portion 'B' of FIG. 7. FIG. 9 is a graph showing chromatic coordinates at the portion 'A' of FIG. 6 as a function of time. The chromatic coordinates are the x and y coordinates in the CIE xyY color coordinate system.

FIGS. 6 to 9 illustrate operation of the display apparatus driven as described above in connection with FIGS. 4 and 5. The total luminance of the light-emitting blocks corresponding to the portion 'A' was measured by an appropriate instrument when the image of FIG. 6 was displayed over a number of frames. The image remained unchanged during the measurement period, which included a number of compensating periods and a number of color-dimming periods.

In the graphs of FIGS. 7 and 8, the time is shown in seconds and the luminance in nits. FIG. 8 shows a first transitional period GI_1, a corresponding compensating period CI, and a corresponding second transitional period GI_2. The total luminance emitted by the light-emitting blocks LB at the portion 'A' gradually increased during the first period GI_1 and gradually decreased during the second period GI_2. The luminance was the highest during the compensating period CI. Symbol WI denotes the total compensating-mode period consisting of the first transitional period GI_1, the compensating period CI, and the second transitional period CI_2. The graph of FIG. 9 shows a number of periods WI. As shown in FIG. 9, each of the chromatic coordinates x and y changes by a factor of less than about ±0.002 in any period WI.

The first and second transitional periods GI_1 and GI_2 smoothen out changes of the chromatic coordinates and the luminance between the color-dimming periods and the compensating periods to make the changes less perceptible to humans. The display quality is therefore enhanced.

In some embodiments of the present invention, in a light source apparatus operated with color-dimming, color light is sensed and adjusted during a compensating period to provide the reference white light having the target luminance and target chromatic coordinates. In addition, transitional periods are inserted between the compensating and color-dimming periods to provide a gradual change of luminance between the compensating and color-dimming periods and thus make the chromatic and luminance transitions less perceptible or possibly imperceptible to a human. Consequently, the multicolor light sources can provide the reference white light whose luminance and chromatic coordinates are approximately constant, even though the light sources' emission may change due to varying thermal conditions, aging, or possibly other factors.

Some embodiments of the present invention provide a local-dimming method for driving a light source module in a display device. The light source module comprises a plurality of independently controllable light-emitting blocks. Each of the light-emitting blocks comprises a plurality of sets of light sources, e.g. the set of red light sources, the set of green light sources, and the set of blue light sources. Each set of light sources consisting of one or more light sources. Different sets of light sources of each light-emitting block emit different colors. Different sets of light-sources are independently controllable according to one or more driving parameters (e.g. LED driving parameters) to allow each light-emitting block to be driven by a first color-dimming process (e.g. as in the color-dimming mode) in which each light-emitting block's output chromaticity and luminance depend on an image displayed by the display device. The local-dimming method comprises: (a) in each of one or more color-dimming periods of time, driving each said light-emitting block by the first color-dimming process; (b) in each of one or more compensating periods of time, driving each said light-emitting block by a full-color process which is independent of the image; (c) in each of said one or more compensating periods of time, while driving each said light-emitting block by the full-color process, sensing light emitted by at least one of the light sources, and based on the sensing, determining the one or more driving parameters' reference driving values operable to generate a reference color by the light-emitting blocks; (d) in at least one of the color-dimming and compensating periods of time, driving each said light-emitting block using the one or more driving parameters' values which depend on the reference driving values; and (e) between at least one of the color-dimming periods and an adjacent one of the compensating periods, gradually switching the light-source module between a state in which the luminance of each said light-emitting block is determined by the first color-dimming process and a state in which the luminance of each said light-emitting block is determined by the full-color process.

The foregoing description illustrates but does not limit the present invention. Other embodiments and variations are within the scope of the present teachings.

What is claimed is:

1. A local-dimming control method for controlling of a driving of a light source module, where the light source module is used to provide backlighting light to an adjacent display panel also provided in a display device that includes the light source module, the display panel having blocks of pixels each containing a respective plurality of pixels with respective pixel areas where the pixels define a resolution of an image produced by the display device, where the display device is configured to operate in a localized dimming mode, where the light source module comprises a plurality of independently controllable light-emitting blocks each corresponding to a respective one of the blocks of pixels of the display panel, at least one of the light-emitting blocks comprising a plurality of different sets of light sources, each respective set of light sources within a respective at least one of the blocks being configured to provide a respective color of sourced light among different sourced colors and each respective set having a correspondingly colored one or more light sources, the different sets of light-sources being independently controllable according to one or more driving parameters to allow each at least one of the light-emitting blocks to be driven to provide first intensities of differently colored source lights during a first time duration in which the display device is displaying an image in accordance with a first localized color-dimming process, wherein during said first time duration, each at least one of the light-emitting blocks' output chromaticity and luminance depend on a corresponding image block in the image then being displayed by the display device, the local-dimming control method comprising:

(a) in at least one of plural repetitions of the first time duration, driving each said at least one of the light-emitting blocks to provide backlighting light to its corresponding one of the blocks of pixels of the display panel in accordance with the first color-dimming process;

(b) in at least one of plural repetitions of second time durations interposed between the first time durations, where during said second time durations the display device is not operating in accordance with a color-dimming process, driving each at least one of the said light-emitting blocks in accordance with a full-color process wherein the at least one light-emitting blocks are driven by reference-determined drive signals which are independent of the image to be then displayed by the display device;

(c) in at least one of said second time durations and while driving each said at least one of the light-emitting blocks by the full-color process, sensing light emitted by at least one of the light sources, and based on the sensing, determining what respective level of reference-determined drive signal or signals are needed to achieve a predetermined luminance and chromaticity output from the at least one of the light sources that is sensed;

(d) in at least one of the first and second time durations, using the determined level or levels of respective reference-determined drive signal or signals for driving at least one of said light-emitting blocks; and (e) between at least one of the first and second time durations, gradually switching operation of the light-source module between a state in which the luminance of each at least one of said light-emitting blocks is determined by the first color-dimming process and a state in which the luminance of each at least one of said light-emitting blocks is determined by the full-color process.

2. The method of claim 1 wherein:

operation (e) is performed during one or more transitional periods between a color-dimming period (said first time duration) and an adjacent compensating period (said second time duration), at least one said transitional period comprising a plurality of frames in each of which the luminance L of each set of the light sources is a function of:

(i) the set's luminance LCD as determined by the first color-dimming process;

(ii) the set's luminance Lfc as determined by the full-color process; and (iii) the current frame; and for each fixed value of LCD and each fixed value of Lfc greater than LCD, all of said functions either gradually increase or gradually decrease with each subsequent frame of the at least one transitional period.

3. The method of claim 2 wherein operation (e) is performed in a transitional period immediately preceding a compensating period and with all of the functions gradually increasing, and operation (e) is also performed in another transitional period immediately preceding a color-dimming period with all of the functions gradually decreasing.

4. The method of claim 1 wherein operation (d) is performed in at least one color-dimming period.

5. The method of claim 4 wherein the one or more reference driving values obtained in at least one of said compensating periods in operation (c) are used in the operation (d) performed in the immediately following color-dimming period.

6. The local-dimming method of claim 1, wherein the sets of the light sources in at least one of said light-emitting blocks comprise a set of one or more red light sources, a set of one or more green light sources, and a set of one or more blue light sources, and wherein the reference-determined drive signals provide a reference color that is a white color.

7. The local-dimming method of claim 6, wherein at least one red light source emits red light in the wavelength range of about 580 nm to about 700 nm, at least one green light source emits green light in the wavelength range of about 460 nm to about 630 nm, and the blue light source emits blue light in the wavelength range of about 400 nm to about 520 nm.

8. The local-dimming method of claim 1, wherein operation (e) is performed immediately before and immediately after at least one compensating period (said second time duration), the total luminance of the light-emitting blocks gradually increasing before the at least one compensating period and gradually decreasing after the at least one compensating period.

9. The local-dimming method of claim 1, wherein operation (c) comprises:

driving each at least one of said light-emitting blocks by the full-color process with the one or more driving parameters having previously obtained reference driving values;

obtaining a result of the sensing in a digital format;

comparing the result of the sensing to reference color data corresponding to the reference color;

determining new reference driving values for the one or more driving parameters based on a comparison of the result of the sensing to the reference color data; and driving each at least one of said light-emitting blocks by the full-color process with the one or more driving parameters having the new reference driving values.

10. A light source apparatus, where the light source apparatus is configured for providing backlighting light to an adjacent display panel of a display device that includes the light source apparatus, the display panel having blocks of pixels each containing a respective plurality of pixels with respective pixel areas where the pixels define a resolution of an image produced by the display device, the light source apparatus comprising:

a light source module that is configured to operate in a localized dimming mode, the light source module comprising a plurality of light-emitting blocks each corresponding to a respective one of the blocks of pixels of the display panel and each being independently controllable to provide correspondingly controlled backlighting light to its respective block of pixels, at least one of the light-emitting blocks comprising a plurality of different sets of light sources, each respective set of light sources within a respective at least one of the light-emitting blocks being configured to provide a respective color of sourced light among different sourced colors and each respective set having a correspondingly colored one or more light sources, each set of light-sources being associated with respective one or more driving parameters determining an input power provided to each light-source of the set to allow each corresponding at least one of the light-emitting blocks to be driven in accordance with a first localized color-dimming process in which each at least one light-emitting block's output chromaticity and luminance depend on a corresponding image block in the image then being displayed by the display device; and a local-dimming driving part configured to provide the one or more driving parameters to the sets of the light-sources, the local-dimming part comprising a light sensing part configured to sense light emitted by the light source module and comprising circuitry for carrying out a process wherein:

(a) in at least one of plural repetitions of the first time duration, driving each said at least one of the light-emitting blocks to provide backlighting light to its corresponding one of the blocks of pixels of the display panel in accordance with the first color-dimming process;

(b) in at least one of plural repetitions of second time durations interposed between the first time durations, where during said second time durations the display device is not operating in accordance with a color-dimming process, driving each said at least one of the light-emitting blocks in accordance with a full-color process wherein the at least one of the light-emitting blocks are driven by reference-determined drive signals which are independent of the image to be then displayed by the display device;

(c) in at least one of said second time durations and while driving each said at least one of the light-emitting blocks by the full-color process, sensing light emitted by at least one of the light sources, and based on the sensing, determining what respective level of reference-determined drive signal or signals are needed to achieve a predetermined luminance and chromaticity output from the at least one of the light sources that is sensed;

(d) in at least one of the first and second time durations, using the determined level or levels of respective reference-determined drive signal or signals for driving each said at least one of the light-emitting blocks; and (e) between at least one of the first and second time durations, gradually switching operation of the light-source module between a state in which the luminance of each said at least one of the light-emitting blocks is determined by the first color-dimming process and a state in which the luminance of each said light-emitting block is determined by the full-color process.

11. The light source apparatus of claim 10, wherein the sets of the light sources in each said at least one of the light-emitting blocks comprise a set of one or more red light sources, a set of one or more green light sources, and a set of one or more blue light sources, and wherein the reference-determined drive signals provide a reference color that is a white color.

12. The light source apparatus of claim 11, wherein at least one red light source emits red light in the wavelength range of about 580 nm to about 700 nm, at least one green light source emits green light in the wavelength range of about 460 nm to about 630 nm, and the blue light source emits blue light in the wavelength range of about 400 nm to about 520 nm.

13. The light source apparatus of claim 11, wherein the local-dimming driving part comprises:

an image analysis part analyzing an image signal corresponding to each at least one of the light-emitting blocks and determining a color-dimming level; and a light source driving part driving the light sources of each at least one of the light-emitting blocks based on the color-dimming level.

14. The light source apparatus of claim 13, wherein the local-dimming driving part further comprises a compensating control part driving the light source module by the full-color process during the one or more compensating periods (said second time durations), and controlling the light source driving part to gradually change the luminance generation of the at least one of the light-emitting blocks during transitions between a state in which the luminance of each said at least one of the light-emitting blocks is determined by the first color-dimming process and a state in which the luminance of each said at least one of the light-emitting blocks is determined by the full-color process.

15. The light source apparatus of claim 14, wherein the compensating control part comprises:

a storage part storing reference data including color reference data corresponding to a reference color to be generated by at least one of the light-emitting blocks in the full-color process, the reference data also including duty-ratio reference data causing the light sources to emit the reference color; and a control part using sensing data from the light sensing part and the color reference data during at least one compensating period to adjust the duty-ratio reference data.

16. The light source apparatus of claim 14, further comprising:

a first printed circuit board (PCB) having the image analysis part disposed on the first PCB;

a second PCB having the light source driving part disposed on the second PCB; and a third PCB disposed between the first and second PCBs and having the compensating control part disposed on the third PCB.

17. The light source apparatus of claim 16, further comprising a sub-PCB disposed between the second and third PCBs, and having connectors mounted on the sub-PCB, the connectors connecting an output signal of the third PCB to an input signal of the second PCB.

18. The light source apparatus of claim 14, wherein:

operation (e) is performed during the transitional periods between a color-dimming period (said first time duration) and an adjacent compensating period, at least one of said transitional periods comprising a plurality of frames in each of which the luminance L of each set of the light sources is a function of:

(i) the set's luminance LCD as determined by the first color-dimming process;

(ii) the set's luminance Lfc as determined by the full-color process; and (iii) the current frame; and the compensating control part controlling the light source driving part so that in at least one transition from a color-dimming period to a compensating period, all of said functions are gradually increasing functions of the current frame for each fixed value of LCD and each fixed value of Lfc greater than LCD, and in at least one transition from a compensating period to a color-dimming period, all of said functions are gradually decreasing functions of the current frame for each fixed value of LCD and each fixed value of Lfc greater than LCD.

19. The light source apparatus of claim 14, wherein the light sensing part comprises:

a light sensor sensing the light emitted the light sources during the full-color process and outputting a color sensing signal;

an amplifier amplifying the color sensing signal and outputting a color amplified sensing signal; and an analog-to-digital converter (ADC) converting the color amplified sensing signal into digital-type color sensing data.

20. A display apparatus comprising:

a display panel configured for displaying an image that is partitionable into corresponding image blocks, the display panel having blocks of pixels each corresponding to a respective image block and each containing a respective plurality of pixels with respective pixel areas where the pixels define a resolution of an image produced by the display device;

a light source module that is configured to operate in a localized dimming mode, the light source module including a plurality of light-emitting blocks each corresponding to a respective one of the blocks of pixels of the display panel and each being independently controllable to provide correspondingly controlled backlighting light to its respective block of pixels, at least one of the light-emitting blocks including a plurality of differently colored, color light sources; and a local-dimming driving part configured for driving the light source module in accordance with a first localized color-dimming process using color-dimming levels determined based on a corresponding image block in the image then being displayed by the display device, where each corresponding image block corresponds to a respective one of the at least one of the light-emitting blocks, the local-dimming driving part being also configured for adjusting the light emitted by the color light sources in a full-color process during a compensating period, and for driving the at least one of the light-emitting blocks to have to gradually change the total luminance of the at least one of the light-emitting blocks during transitions between a state in which all the at least one light-emitting blocks are driven by the first color-dimming process and a state in which all the at least one light-emitting blocks are driven by the full-color process.

21. The display apparatus of claim 20, wherein the local-dimming driving part comprises:

an image analysis part analyzing an image signal corresponding to each at least one light-emitting block and determining the color-dimming levels;

a light source driving part driving the color light sources of each at least one light-emitting block based on the color-dimming levels;

a compensating control part driving the light source module by the full-color process during the compensating period, and controlling the light source driving part so that the at least one of the light-emitting blocks have the gradually changed total luminance during the transitional period; and a light sensing part sensing the amount of the light emitted by the color light sources during the full-color process and outputting color sensing data.

22. The display apparatus of claim 21, wherein the compensating control part controls the light source driving part, so that when an image is unchanged during a first period before the compensating period and an image is unchanged during a second period after the compensating period, then the total luminance of the light source blocks is gradually increased during the first period and the total luminance of the light source blocks is gradually decreased during the second period.

* * * * *